US006510966B1

(12) United States Patent
Perry et al.

(10) Patent No.: US 6,510,966 B1
(45) Date of Patent: Jan. 28, 2003

(54) ROTARY VIBRATING APPLICATOR FOR VISCOUS MATERIALS

(75) Inventors: Mark D. Perry, Chaska, MN (US); Martin P. McCormick, Forest Lake, MN (US)

(73) Assignee: Graco Inc., Minneapolis, MN (US)

( * ) Notice: Subject to any disclaimer, the term of this patent is extended or adjusted under 35 U.S.C. 154(b) by 0 days.

(21) Appl. No.: 09/434,524

(22) Filed: Nov. 5, 1999

Related U.S. Application Data

(60) Provisional application No. 60/107,117, filed on Nov. 5, 1998.

(51) Int. Cl.[7] ..... B67D 5/60

(52) U.S. Cl. ..... 222/145.6; 222/161; 222/196; 222/200; 222/459

(58) Field of Search ..... 222/145.6, 161, 222/196, 199, 200, 459; 239/102.1

(56) References Cited

U.S. PATENT DOCUMENTS

| | | | | |
|---|---|---|---|---|
| 3,874,595 A | | 4/1975 | Rindisbacher | 239/227 |
| 3,924,808 A | | 12/1975 | Cooley et al. | 239/102 |
| 4,407,338 A | | 10/1983 | Kleinsorgen et al. | 141/1 |
| 4,844,003 A | | 7/1989 | Slautterback et al. | 118/323 |
| 4,846,099 A | | 7/1989 | Krippl et al. | 118/323 |
| 4,967,962 A | | 11/1990 | Kawaguchi et al. | 239/263.1 |
| 5,119,990 A | | 6/1992 | Kasasi et al. | 239/102.1 |
| 5,341,963 A | * | 8/1994 | Mott et al. | 222/196 |
| 5,499,745 A | * | 3/1996 | Derian et al. | 222/145.6 |
| 5,656,339 A | | 8/1997 | Wesseling et al. | 427/600 |
| 5,773,095 A | | 6/1998 | Coker | 427/424 |
| 5,979,794 A | * | 11/1999 | DeFillipi | 222/145.6 |

FOREIGN PATENT DOCUMENTS

| | | | |
|---|---|---|---|
| JP | 0142213 | * 11/1980 | 222/196 |

* cited by examiner

*Primary Examiner*—Joseph A. Kaufman
(74) *Attorney, Agent, or Firm*—Douglas B. Farrow

(57) ABSTRACT

An air driven vibrator is attached to a robotic applicator for sealants and adhesives. When the plane of vibration is normal to the axis of the dispenser, the vibration will impart a rotary motion to the applicator. When the plane of vibration is parallel to the axis of the dispenser and normal to the direction of motion of the dispenser (such dispensers are usually robot mounted), a side-to-side or pendulum action is provided. When the dispense tip is provided with a static mixer to mix plural component materials, the vibrator will enhance the mixer's action.

5 Claims, 2 Drawing Sheets

ROTARY VIBRATING APPLICATOR FOR VISCOUS MATERIALS

This application claims the benefit of Ser. No. 60/107,117, filed Nov. 5, 1998.

BACKGROUND OF THE INVENTION

So-called swirl applicators have been used to apply pressurized sealants and adhesives for a number of years. Typically such swirl applicators have used air streams to impart a swirling motion to the fluid stream. While such constructions work for their intended purpose, they are often prone to clogging and require precise setup to achieve the desired results. While other applicators have used a mechanism to rotate the dispense nozzle, those devices have tended to be somewhat complex and relatively more expensive.

SUMMARY OF THE INVENTION

It is therefore an object of this invention to produce a swirl applicator which provides satisfactory application of current sealants and adhesives. It is yet another object of this invention to provide such a device which can be easily and inexpensively manufactured. In the instant invention, an air driven vibrator is attached in several ways to an applicator. When the plane of vibration is normal to the axis of the dispenser, the vibration will impart a rotary motion to the applicator. When the plane of vibration is parallel to the axis of the dispenser and normal to the direction of motion of the dispenser (such dispensers are usually robot mounted), a side-to-side or pendulum action is provided. When the dispense tip is provided with a static mixer to mix plural component materials, the vibrator will enhance the mixer's action.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
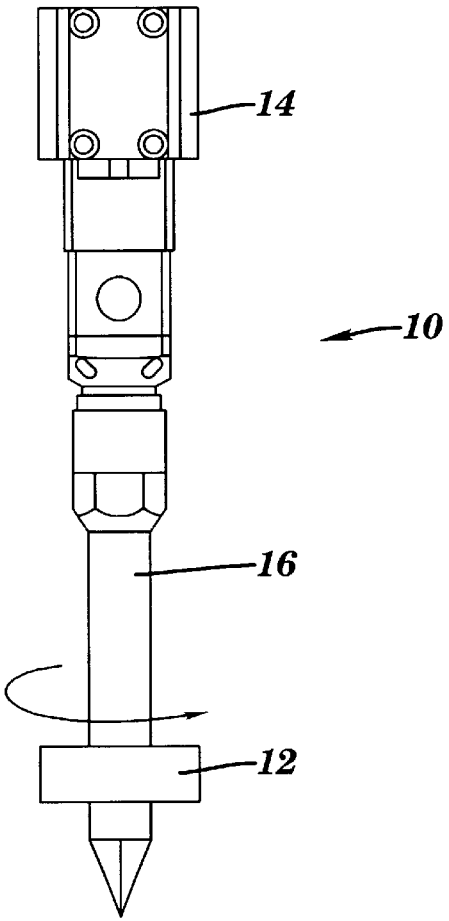
FIG. 1 is a side view of the instant invention where the plane of vibration is normal to the axis of the dispenser.

In the instant invention, generally designated 10, an air driven vibrator 12 may attached in several ways to an applicator 14 having a dispense tip 16. As shown in FIG. 1, when vibrator 12 is mounted to the dispense tip 16 so that the plane of vibration is normal to the longitudinal axis of the dispense tip 16, the vibration will impart a rotary motion to the applicator and thence to the swirl pattern.

Figure 2:
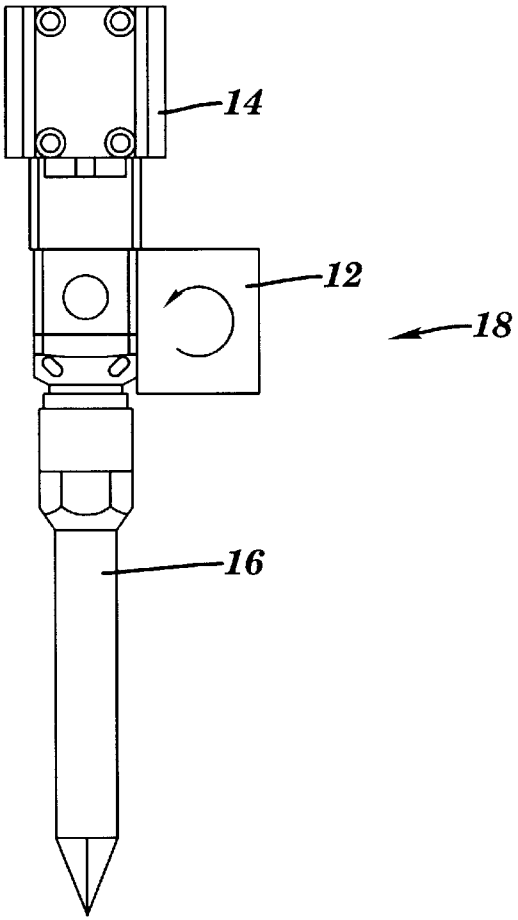
FIG. 2 is a side view of the instant invention where the plane of vibration is parallel to the axis of the dispenser and normal to the direction of motion of the dispenser.

As shown in FIG. 2, when vibrator 12 is mounted to dispense tip 16 so that the plane of vibration is parallel to the axis of the dispense tip 16 and normal to the direction of motion of the dispenser (such dispensers are usually robot mounted), a side-to-side or pendulum action is provided.

Figure 3:
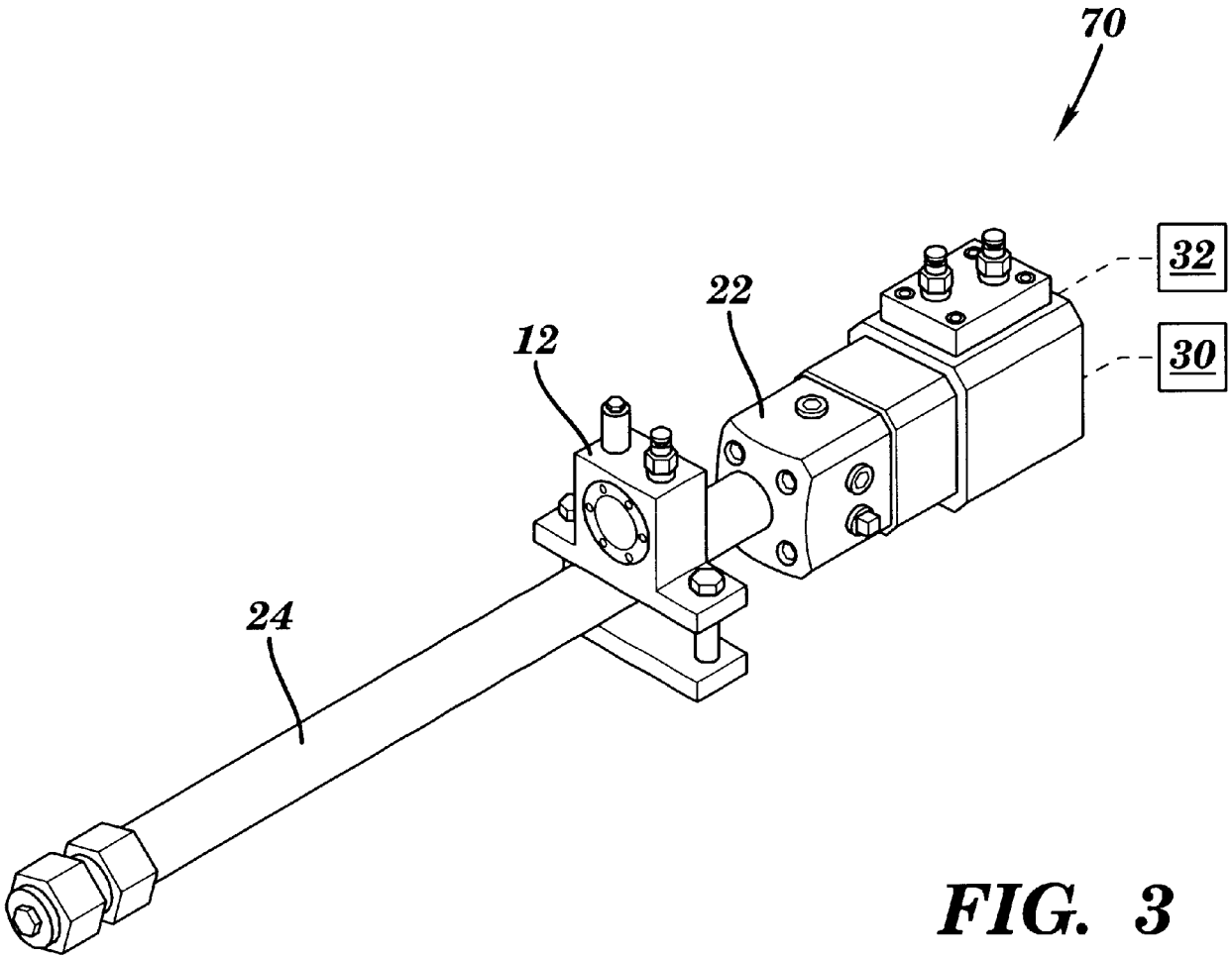
FIG. 3 is a perspective view of the instant invention with a static mixer.

As shown in FIG. 3, when the dispense tip 24 is provided with a conventional static mixer therein to mix plural component materials, the vibrator 12 will enhance the mixer's action.

The vibrators in question are preferably driven by compressed air and examples of such are manufactured and sold by Martin Engineering of Livonia, Mich. under model no. GT-10 (a turbine type). Also, the vibrator may be located at various points along the length of the dispense tip 16 or applicator 14 to vary the effect on the pattern produced.

It is contemplated that various changes and modifications may be made to the swirl applicator without departing from the spirit and scope of the invention as defined by the following claims.

What is claimed is:

1. An orbital dispenser for application of viscous materials, said dispenser comprising:

a fixed mounting point;

a dispense tube having a longitudinal axis and extending from said mounting point; and a rotary vibrator mounted to said tube remote from said fixed mounting point to induce lateral vibration therein relative to said longitudinal axis and said fixed mounting point to produce a swirl pattern of the material being dispensed.

2. The orbital dispenser of claim 1 wherein said rotary vibrator vibrates in a plane normal to said longitudinal axis.

3. The orbital dispenser of claim 1 wherein said rotary vibrator vibrates in a plane parallel to said longitudinal axis.

4. The orbital dispenser of claim 1 further comprising a pressurized source of viscous materials connected to said dispense tube.

5. The orbital dispenser of claim 1 further comprising:

a plurality of pressurized sources of viscous materials connected to said dispense tube; and a static mixer located in said dispense tube, said vibrator serving to enhance the mixing action in said static mixer.

* * * * *